US006056646A

United States Patent [19]

Soong

[11] Patent Number: 6,056,646

[45] Date of Patent: May 2, 2000

[54] GOLF CLUB SHAFT WITH INNER MEMBER

[76] Inventor: Tsai C. Soong, 1839 Jackson Rd., Penfield, N.Y. 14526

[21] Appl. No.: 08/931,569

[22] Filed: Sep. 16, 1997

[51] Int. Cl.[7] ..... A63B 53/10; A63B 53/12

[52] U.S. Cl. ..... 473/298; 473/318

[58] Field of Search ..... 473/316–323, 473/295–298

[56] References Cited

U.S. PATENT DOCUMENTS

| | | | |
|---|---|---|---|
| Re. 34,767 | 10/1994 | Soong . | |
| 1,212,038 | 1/1917 | Flaxman | 473/44 |
| 2,051,083 | 8/1936 | Hart | 473/297 |
| 3,461,593 | 8/1969 | Martuch et al. | 473/318 |
| 4,214,395 | 7/1980 | Caldwell | 473/318 |
| 4,971,321 | 11/1990 | Davis | 473/287 |
| 5,054,781 | 10/1991 | Soong . | |
| 5,080,363 | 1/1992 | Soong . | |
| 5,398,934 | 3/1995 | Soong . | |
| 5,465,967 | 11/1995 | Boeckenhaupt | 473/297 |
| 5,478,075 | 12/1995 | Saia | 473/318 |
| 5,588,920 | 12/1996 | Soong . | |

*Primary Examiner*—Sebastiano Passaniti
*Assistant Examiner*—Stephen L. Blau

[57] ABSTRACT

A golf club comprising a shaft, having a handle end where grip may be installed and a head end where head may be installed, said shaft is characterized by having a concentric inner member, at least partially covered by the shaft, comprising a handle end, rigidly joined to said handle end of the shaft and the other end extending towards said head end, said inner member is designed to engage the shaft internally at the end extending towards the head end of said shaft at least when said shaft is bent during swing of the golf club.

7 Claims, 2 Drawing Sheets

GOLF CLUB SHAFT WITH INNER MEMBER

BACKGROUND OF THE INVENTION

The shaft of a conventional golf club as shown in FIG. 1 will always be bent in a so-called primary mode in mechanics when the golf club is being swung. The primary mode is shown in FIG. 2 where the end 2 is the butt end of the shaft in the grip portion and the other end 3 is a free end where a head is attached. The inertia force 4 would be acting when the club is being swung. From point 5 to 6, a simple harmonic half-wave curve is formed by the axis of the bent shaft. Such bent shape is called a primary mode. The bent shaft should recover its straightness at the end of the swing and the speed of the head at the instant the head hitting the ball depends on the speed of recovery of the curved shape back to its undeformed state. The time required to become straight is called frequency. The invention is to install a structural member in the interior space of the shaft which will interact with the shaft when the shaft bends so as to alter said primary mode of the bent shaft into a higher frequency mode so that the recovery of the bent shape of the golf club shaft to become straight again could be faster, and consequently the speed of the head when it hits the ball is greater than the conventional shaft bent in the primary mode.

BRIEF DECRIPTION OF THE DRAWINGS

Figures only depict some of the preferred embodiments of the invention among all practically possible and desirable arrangements.

DESCRIPTION OF THE PREFERRED EMBODIMENTS

Figure 1:
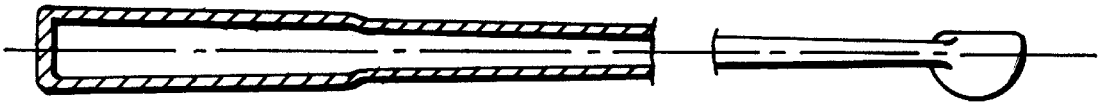
PRIOR ART FIG. 1
FIG. 1 shows a conventional golf club shaft.
Figure 2:
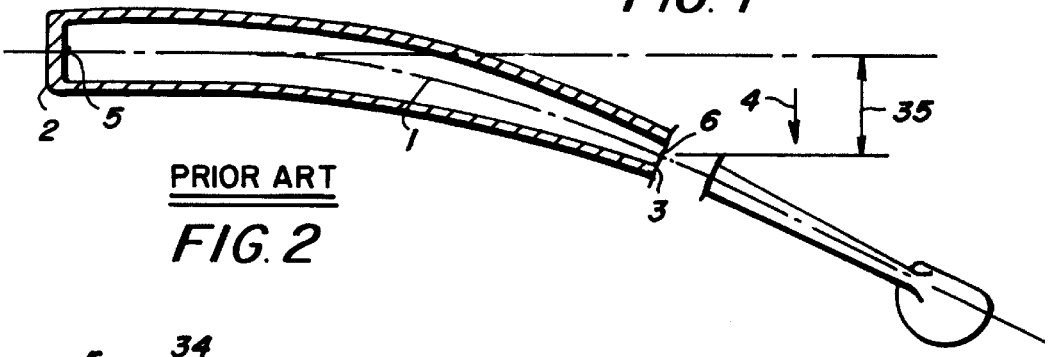
PRIOR ART FIG. 2
FIG. 2 shows the FIG. 1 shaft as being bent by the inertia of the head during swing of the club.
Figure 3:
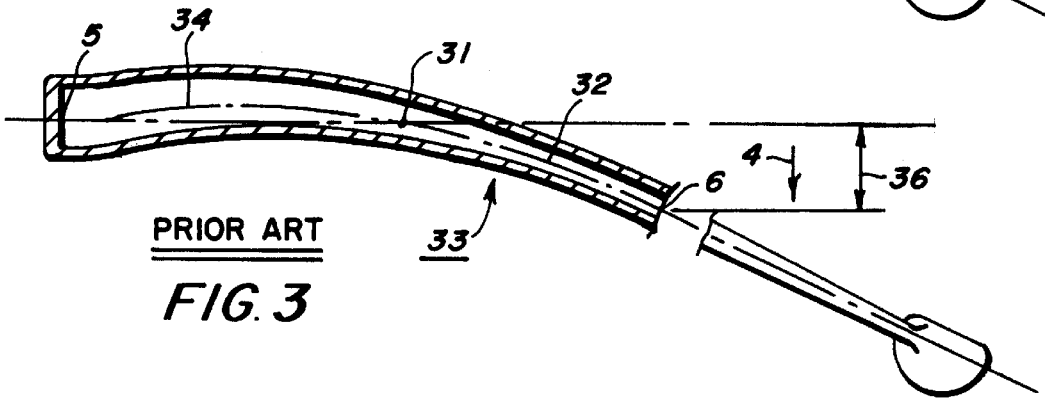
PRIOR ART FIG. 3
FIG. 3 shows the shaft in FIG. 1 as being bent into a higher frequency mode by the presence of an intermediate lateral contact force.

The invention is to produce an internal, discrete, lateral force at an intermediate point along the length of the shaft when the shaft bends. Such a force is shown as a force 33 in FIG. 3 acting at point 31 along the axis 32 which is in a direction opposite to the head inertia force 4. The new shaft has the outer appearance approximately of a conventional shaft. Forces 33 and 4 form a couple. As a result, the bending moment along the shaft from 5 to 31 is changed, so is the deflection of the shaft. Due to the upward bending moment created by the lateral force, an inverse bend curve from 5 to 34 appears between the butt end 5 of the handle and the point of inflection 34. Point of inflection is the mathematical term in geometry about a point which connects an upward curvature to a downward curvature. The bending moment acting in the shaft changes sign at a point of inflection. Therefore, the curved center line 32 of the shaft has an upwardly curved portion from 5 to 34, immediately followed by a downwardly curved portion 34 up to the end point 6. Even though the length of the butt end portion 5 to 34 is relatively short, however, due to its proximity to the butt end where the hand is holding the shaft, and the fact that the shaft bends upwardly at 34, the total deflection of the head 35 of FIG. 2 and 36 of FIG. 3 are significantly different.

The range of 36 is smaller than 35. To execute the return to straightness of the shaft near the end of the swing, a shaft like FIG. 2 will have to swing back upwardly in its entire length from 5 to 6. The speed of recovery is relatively slow for the primary mode. However, for the FIG. 3 shaft to return to straight, the curved portion from 5 to 31 would simply swing downward and the curve from 31 to 6 would move upward. Both movements are relatively short The required bending moments in each arc are opposite to each other, one rotates down and the other up. rhythmically. Therefore, the FIG. 3 shaft will return to its straightness much faster than its FIG. 2 counterpart. In mechanics, the two-curvature shape of FIG. 3 is a higher frequency mode. It means it vibrates faster. The head will hit the ball at a faster speed in FIG. 3 than the FIG. 2 conventional club.

The novelty of the invention besides changed the vibration mode of the golf club, should also include the design of the rigid inner member in the restricted space inside the original shaft, having appropriate length and rigidity to engage the shaft, to produce the two-curvature higher frequency vibration mode whenever the club is swung.

A Preferred Embodiment

Figure 4:
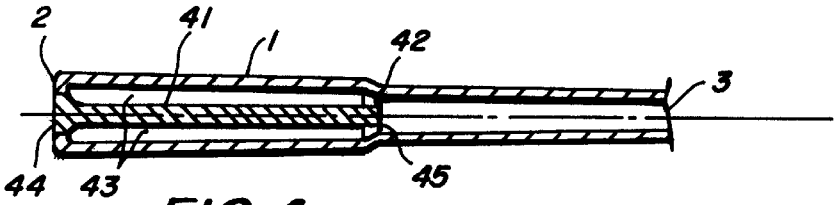
FIG. 4 shows a preferred embodiment of the invention.
Figure 5:
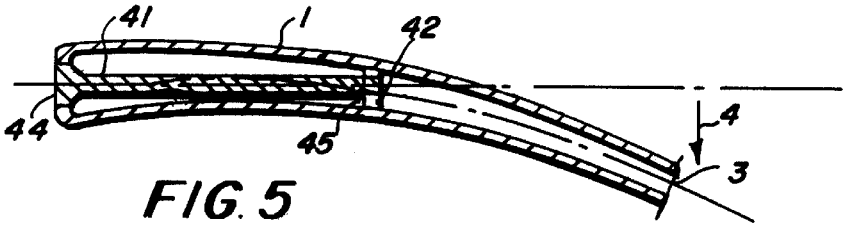
FIG. 5 shows the FIG. 4 shaft as being bent during swing of the club.

FIG. 4 shows a preferred embodiment of the structural arrangement and FIG. 5 shows the corresponding bending of the shaft under head force 4. In the embodiment, there is arranged to have a relatively short inner member 41 installed inside the general handle portion of shaft 1, wherein the handle end 44 of the inner member is joined rigidly with the handle end 2 of the shaft, and its other end 45 is extending towards the head end 3 of the shaft. Rigid joint may mean mechanically joining the two parts together by welding, riveting or other conventional means, and it may also mean manufactured integrally by molding, casting or other means when the two parts are of the same material. The golf player is holding the joined end of the shaft and the inner member. The inner member is concentric to the shaft, circular or other cross sectional shape, hollow or solid, metal or reinforced fiber composite. It is preferred to be stiffer in bending than that of shaft 1, in the length from between the center points 44 to 45. As a matter of fact, it is preferred that its cross sectional size enables it to remain almost straight during swing, as is seen in the exaggerated sketch of FIG. 5. Since the distribution of the bending moment in shaft 1 and 41 is proportional to their respective bending rigidity, bending will be borne in this case mostly by the shaft if the inner member is stiffer and rigid enough. Besides the butt end 44, the inner member does not contact the shaft anywhere else along the length, even when the shaft is bent, except at the tip point 45. This is the structural requirement of the invention.

Figure 6:
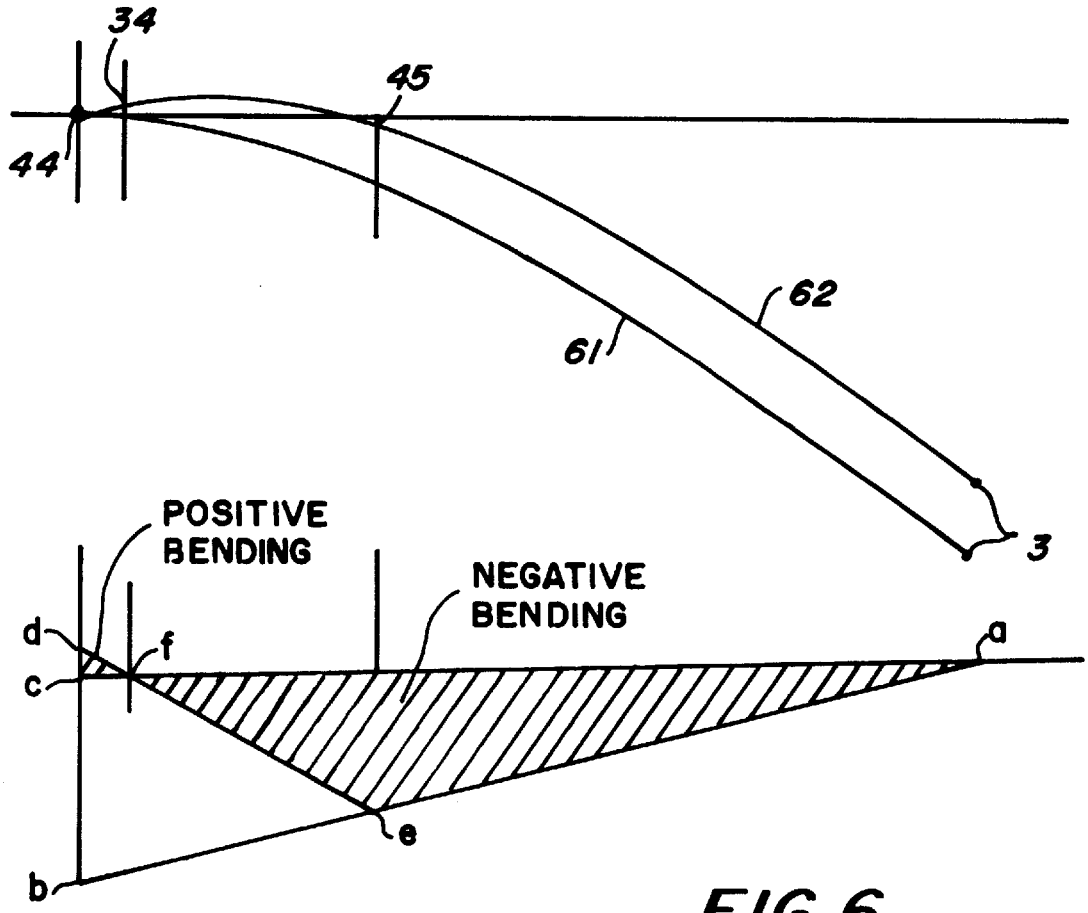
FIG. 6 shows the moment diagrams of the two shafts.

That the inner member greatly alters the bending moment distribution of the shaft may be seen in FIG. 6. The curve 61 is the center line of the shaft of the primary mode vibration shown in FIG. 2 with the load applied at 3. The corresponding moment diagram of the primary mode is the triangle a-b-c, all negative bending. With the inner member pushing the shaft at 45, having an inflection point 34, the moment diagram of the shaft is changed to a-e-f for region 34 to 3 and to f-d-c for the region close to the butt end. These two moments are opposite in sign. The inflection point 34 can be shifted to the left or to the right by having the inner member shorter and less stiff or longer and more stiff. The recovery speed of the shaft would be faster if the inflection point is more to the right in FIG. 3. However, it would be difficult to extend the inner member too long toward the head end 3 of the shaft and maintain great bending rigidity because the golf club shaft tapers towards its head end quite rapidly.

Another merit of having the inner member inside the shaft is that the inner member being closer to the head of the golf club enables the shaft to control the head better, reduces head wobbling during swing significantly and the ball is being driven away more accurately. These are observed as merits besides a faster head speed in field tests of the new device.

At the tip point 45 of the inner member, there is installed a cushion 42, which is optional, made of elastic material, such as rubber or other polymers. When shaft 1 is bent due to swing, the stiff inner member will be exerting lateral force to the shaft through the cushion. This contact force is the force 33 shown in FIG. 3.

It is to be noted the diameters of both shafts between 44 and 45 may be varied along their length. There should be ample space 43 maintained at least partially between the two shafts along the major portion of the length of the inner member 41 so that when shaft 1 is bent during swing, the inner member won't interfere the bending which allows the shaft to store bending energy.

Since the inner member is an extension of the hands which hold and swing the golf club, its length should be significantly longer than the length of a hand grip which for a man is about 20 cm. However, if it is too long, then the length of the shaft between 31 and 6 in FIG. 3 is too short and the deflection 36 is too small for a good range. The general impression after some tests is that the length should be between 25 cm to 50 cm.

What is claimed is:

1. In a golf club having a shaft which is hollow substantially along the entire length with a handle at one end and a club head at the other end, the golf shaft being adapted to bend during swinging thereof during golf play, the improvement including, an elongated nonrotatable rigid member positioned within the handle of the shaft coaxial therewith and having one end thereof rigidly secured adjacent to the handle end of the shaft, and its other end extending toward the club head, said rigid member being (arranged) adapted to engage the shaft internally only at said other end when the shaft is not bent, and when the shaft is bent during swinging of the golf club and to exert a lateral force against the shaft in accordance with the amount of bending at the engaged point thereof, said inner member being arranged for producing a reverse curvature having an inflection point between said ends thereof, thereby forming a frequency mode higher than the slower primary frequency mode of a club without an elongated rigid member, resulting in a higher head speed when the same hits a ball at the end of a swing.

2. The golf club as defined in claim 1 wherein said rigid member is a substantially cylindrical shaft arranged concentrically with the golf shaft in axial alignment therewith.

3. The golf club as defined in claim 1 wherein the length of said rigid member is at least 25 cm in order to provide optimum straightening condition.

4. The golf club as defined in claim 1 wherein the average bending rigidity of the rigid member, along the major portion of the length of the member, defined as the product of its cross sectional moment of inertia and the Young's modulus of the material, is greater than that of the shaft covering the rigid member.

5. The golf club as defined in claim 1 wherein the presence of the rigid member which exerts lateral force to the shaft when the shaft is bent due to the swinging of the golf club, enables the shaft to have less deflection at the head end than it would if the rigid member is removed.

6. The golf club as defined in claim 1 wherein the rigid member is in contact with the shaft, even when the shaft is fully bent due to the swinging of the golf club, in no other place except at the butt end and at the other end extending toward the club head.

7. The golf club as defined in claim 1 wherein the presence of the rigid member enables the shaft to deflect in such a way that there is a second point along the length of the shaft whose tangent line of the deflection curve thereof is horizontal, parallel to the tangent line at the butt end of the shaft.

* * * * *